US011148843B2

(12) United States Patent
Giublin et al.

(10) Patent No.: US 11,148,843 B2
(45) Date of Patent: Oct. 19, 2021

(54) METHOD OF PACKAGING A SET OF STACKED LIDS AND PACKAGING DEVICE FOR SETS OF STACKED LIDS

(71) Applicant: Ball Beverage Can South America S.A., Águas Claras (BR)

(72) Inventors: Bruno Leonardo Giublin, São José dos Campos (BR); Guilherme Kisseloff Coracini, São José dos Campos (BR); Tales Gustavo Vieira, Belo Horizonte (BR)

(73) Assignee: BALL BEVERAGE CAN SOUTH AMERICA S.A., Rio de Janeiro (BR)

( * ) Notice: Subject to any disclaimer, the term of this patent is extended or adjusted under 35 U.S.C. 154(b) by 371 days.

(21) Appl. No.: 15/532,535

(22) PCT Filed: Dec. 3, 2015

(86) PCT No.: PCT/IB2015/059332
§ 371 (c)(1),
(2) Date: Jun. 2, 2017

(87) PCT Pub. No.: WO2016/088080
PCT Pub. Date: Jun. 9, 2016

(65) Prior Publication Data

US 2017/0349310 A1 Dec. 7, 2017

(30) Foreign Application Priority Data

Dec. 4, 2014 (BR) ..... 1020140303154

(51) Int. Cl.
*B65B 43/46* (2006.01)
*B65B 5/06* (2006.01)
(Continued)

(52) U.S. Cl.
CPC ..... *B65B 43/465* (2013.01); *B65B 5/067* (2013.01); *B65B 43/18* (2013.01); *B65B 43/34* (2013.01); *B65B 5/065* (2013.01)

(58) Field of Classification Search
CPC ..... B65B 43/465; B65B 5/067; B65B 43/18; B65B 43/34
(Continued)

(56) References Cited

U.S. PATENT DOCUMENTS 3,763,628 A * 10/1973 Bodolay ..... B65B 5/067 53/572
3,858,380 A * 1/1975 Schmechel ..... B29C 66/8244 53/52
(Continued)

FOREIGN PATENT DOCUMENTS

CN 102910466 A 2/2013
CN 203921314 U 11/2014
(Continued)

OTHER PUBLICATIONS

Written Opinion and Search Report for PCT/IB2015/059332 dated Mar. 17, 2016 (13 pages).
(Continued)

*Primary Examiner* — Gloria R Weeks
(74) *Attorney, Agent, or Firm* — Greer, Burns & Crain, Ltd.

(57) ABSTRACT

The present invention relates to a method of packaging a set of stacked lids, which includes the steps of capturing an empty, flat package (12), comprising an inlet (25), by securing a vacuum terminal (8) in the immediate proximity of the inlet (25) of the package (12) and maintaining this package (12) straight; maintaining the vacuum terminal (8) activated, retaining the package (12), and producing an air jet towards the inlet (25) of the package (12) so as to open
(Continued)

the inlet (25) of the package (12); maintaining a vacuum terminal (8) activated, retaining the package (12) and fitting the inlet (25) of the package (12) thus opened in a feed nozzle (5); transferring into the package (12) a set of stacked lids (6), the set of lids (6) passing through the feed nozzle (5) and the inlet (25) of the package (12) to the interior of the package (12).

The present invention also relates to a packaging device for sets of stacked lids.

7 Claims, 4 Drawing Sheets

(51) Int. Cl.
*B65B 43/18* (2006.01)
*B65B 43/34* (2006.01)

(58) Field of Classification Search
USPC ..... 53/473, 475, 384.1, 385.1, 386.1
See application file for complete search history.

(56) References Cited

U.S. PATENT DOCUMENTS

| | | | | |
|---|---|---|---|---|
| 4,183,194 | A * | 1/1980 | Lucke | B65B 5/067 53/371.6 |
| 4,248,032 | A | 2/1981 | Woods | |
| 4,537,015 | A * | 8/1985 | Inglett, Jr. | B65B 43/18 493/313 |
| 5,016,420 | A * | 5/1991 | Chiappe | B65B 9/13 53/138.1 |
| 5,136,826 | A * | 8/1992 | Carson | B65B 5/06 414/416.07 |
| 5,179,819 | A * | 1/1993 | Sukeyasu | B65B 9/13 53/386.1 |
| 7,363,753 | B2 * | 4/2008 | Gates | B65B 43/18 53/284.7 |
| 7,568,328 | B2 * | 8/2009 | Imao | B65B 5/045 53/284.7 |
| 9,352,867 | B2 * | 5/2016 | Actis | B65B 5/045 |
| 9,617,021 | B2 * | 4/2017 | McCorkle | B65B 5/045 |
| 2002/0124533 | A1 * | 9/2002 | Schmetzer | B65B 5/067 53/438 |
| 2008/0110132 | A1 | 5/2008 | Yan Ruz | |
| 2012/0192527 | A1 | 8/2012 | Manzon | |
| 2012/0292223 | A1 | 11/2012 | Chenail | |
| 2017/0327256 | A1 * | 11/2017 | Giublin | B65B 5/067 |
| 2017/0349310 | A1 | 12/2017 | Giublin et al. | |
| 2018/0215486 | A1 * | 8/2018 | Franzaroli | G06F 9/451 |

FOREIGN PATENT DOCUMENTS

| | | | | |
|---|---|---|---|---|
| EP | 0618134 | A1 * | 10/1994 | B65B 5/067 |
| EP | 3228548 | A1 | 10/2017 | |
| JP | 2007320610 | A | 12/2007 | |
| JP | 4160606 | B2 | 10/2008 | |
| JP | 2009269672 | A | 11/2009 | |
| WO | 9855361 | A1 | 12/1998 | |
| WO | 2016088080 | A1 | 6/2016 | |

OTHER PUBLICATIONS

Chinese Office Action for Corresponding Chinese Patent Application No. 201580062048.8.

Examination Report for corresponding Canadian Patent Application No. 2,969,187 dated Jan. 9, 2018 (3 pages).

* cited by examiner

METHOD OF PACKAGING A SET OF STACKED LIDS AND PACKAGING DEVICE FOR SETS OF STACKED LIDS

The present invention relates to the field of packaging sets of stacked lids.

Such a set of lids is generally applied in manufacturing metal containers, more particularly cans, such as cans used in the food industry for canning food or drink.

These cans are usually made up of a can body and a can lid that are provided separately to the company that fills the package/can.

The supply of lids to the packaging company consists, in general, in the delivery of pallets loaded with stacked sets of lids, each stack being inserted into a package that generally has the shape of an elongate bag.

In producing these lid pallets, there is the need to optimize the method that allows grouping the lids on stacks, inserting the stacks in the packages, closing the packages, and securing this package on a pallet. The optimization of the method refers to the grouping of a larger number of stacks in the packages in a shorter time interval.

DESCRIPTION OF THE PRIOR ART

Several packaging industries are involved with managing and packaging stacked objects.

Document U.S. Pat. No. 4,537,010 discloses an automated process of packaging can lids in which a tab located in the mouth of a bag is trapped between a lip and a clamping member, while a vacuum system pulls the bag down to open it.

A hinged horn is then inserted within the bag and it is opened to enable insertion of the lids.

Document PT1559650 describes an automatic bagging machine of lids in self-adhesive bags. This machine uses a bag extractor mounted in a set of guides running above a bagging line, a shifting device for the bags, two cylinders for the holding the bags, one of these being the bearer of a tongue which is inserted in the bag, an air jet to open the bags, a mobile cone that is inserted in the bags, and compaction cylinders.

BRIEF DESCRIPTION OF THE INVENTION

The purpose of the present invention is to improve the methods and the devices already known.

To this end, the invention relates to a method for packaging a set of stacked lids, including the following steps:

- capturing an empty, flat package, which includes an inlet, by securing a vacuum terminal in the immediate proximity of the inlet of the package;
- keeping the vacuum terminal enabled, retaining the package, and producing an air jet towards the inlet of the package, so as to open the inlet of the package;
- keeping the vacuum terminal enabled, retaining the package, and fitting the open inlet of the package in a feed nozzle;
- transferring into the package, through the inlet, a set of stacked lids, wherein the set of lids goes through the feed nozzle and the inlet of the package into the interior of the package.

Another object of the invention is a packaging device for sets of stacked lids, including:

- a vacuum terminal and a feed nozzle, movable relative to each other;
- equipment for producing an air jet;

- a command unit programmed for the implementation of the method as defined above.

The invention thus enables passing from an empty and flattened bag into a package filled with lids in a reduced number of operations, and also involves a reduced number of devices.

The method and the device according to the invention thus provide cost and efficient gains. Moreover, simplification of the process and material, using few moving parts, has positive consequences on the maintenance of equipment, increasing its robustness and life cycle.

The method may further include one of the following optional characteristics, or a combination of these characteristics.

Producing an air jet is kept activated after the step of keeping the vacuum terminal enabled, retaining the package, and producing an air jet towards the inlet of the package in order to open the inlet of the package; and throughout the step of fitting the open inlet of the package in a feed nozzle; so that the package expands during said fitting step.

The package is kept straight by securing a second terminal at the rear of the package.

The step of producing an air jet towards the inlet of the package is performed by aligning the inlet of the package with the feed nozzle.

The air jet is produced from the feed nozzle.

The step of fitting the open inlet of the package in a feed nozzle is performed by moving the vacuum terminal.

The step of transferring into the package a set of stacked lids is performed by pushing the set of stacked lids through the feed nozzle with an axial displacement rod.

The device may further include one of the following optional characteristics, or a combination of these characteristics.

The vacuum terminal is mounted on a movable support tool and the feed nozzle is mounted on a fixed feed tool.

The feed tool includes a rail aligned with the nozzle.

The device for producing an air jet includes an air injection nozzle injection of air in the feed nozzle.

The device includes three aligned vacuum terminals.

The feed nozzle is beveled.

The feed nozzle includes a slot for passage of the vacuum terminal.

The device includes an axial displacement rod adapted to pass through the feed nozzle.

The invention also relates to a method for packaging a set of stacked lids, including the following steps:

- capturing an elongate package with at least one vacuum terminal mounted on a support tool;
- moving the support tool, carrying the package to a position where a inlet of the package cooperates with a feed tool;
- immobilizing the package with at least one immobilizing device mounted in the support tool and arranged about the package;
- transferring into the package a set of stacked lids.

Another object of the invention is a packaging device for a set of stacked lids, including:

- a support tool adapted to be mounted on a robotic arm;
- at least one vacuum terminal mounted on the support tool;
- at least one immobilizing device mounted on the support tool along with the at least one vacuum terminal;
- a command unit programmed to activate, in coordination, at least one vacuum terminal and the at least one immobilizing device.

The method may further include one of the following optional characteristics, or a combination of these characteristics.

After the step of transferring into the package a set of stacked lids, the method includes a step of compressing the set of lids against the at least one immobilizing device comprising a stop.

The set of lids is kept compressed between the stop and another immobilizing device comprising a front claw.

The step of keeping straight an elongate package is carried out by maintaining the package between the front vacuum terminal and a rear vacuum terminal, mounted aligned on the support tool.

The step of moving the support tool to a position for cooperating with a feed tool is performed after opening an inlet of the package.

The step of moving the support tool to a position for cooperating with a feed tool is performed by fitting the inlet of the package in a feed nozzle of the feed tool.

The step of immobilizing the package with at least one immobilizing device is performed with a stop adapted to cooperate with the end of the package opposite the inlet.

The step of immobilizing the package with at least one immobilizing device is performed with at least one claw adapted to cooperate with the side portion of the package.

The device may further include one of the following optional characteristics, or a combination of these characteristics.

The device includes a front vacuum terminal and a rear vacuum terminal, mounted and aligned on a support tool rod.

The vacuum terminals are mounted on the rod, each one by means of a cylinder allowing a transverse displacement of the rod of each vacuum terminal.

The at least one immobilizing device includes a stop mounted on the rod and aligned with the vacuum terminals.

The at least one immobilizing device includes a front claw mounted on the rod and adapted to actuate on one each side of the vacuum terminals line.

The at least one immobilizing device includes a front claw mounted on the rod and adapted to actuate on one each side of the rear vacuum terminal.

The command unit is also programmed to actuate a package opening device.

BRIEF DESCRIPTION OF THE DRAWINGS

The invention is explained below with the aid of the description of a preferred embodiment, given by way of example, with reference to the figures, in which.

DETAILED DESCRIPTION OF THE FIGURES

Figure 1:
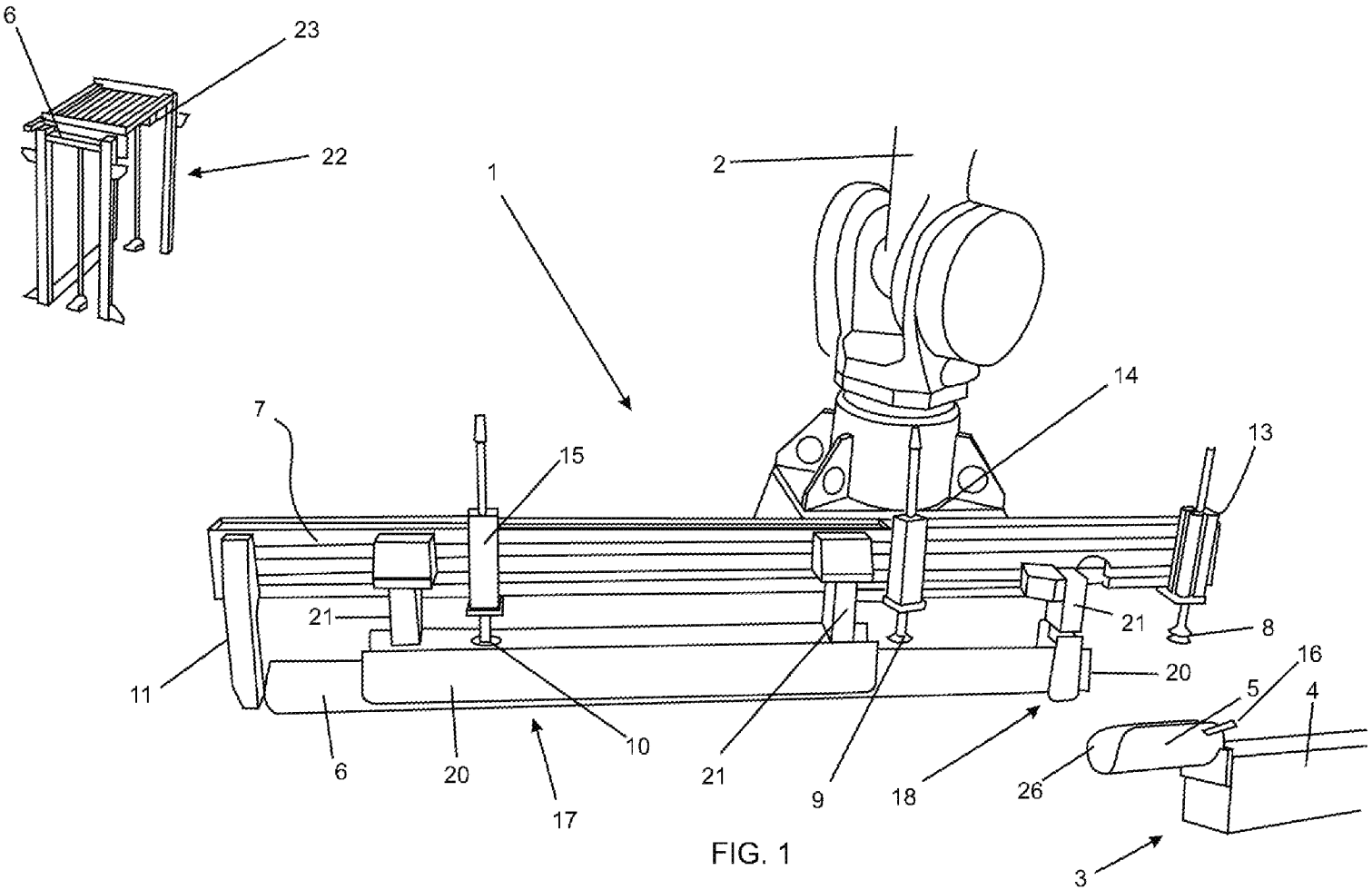
FIG. 1 is a perspective view of a device according to the invention.

FIG. 1 shows devices adapted for packaging sets of lids. These devices include a support tool 1 mounted on a robotic arm 2 and a feed tool 3.

These tools 1, 3 may be inserted in a production line of can lids, in accordance with the standards of the packaging industry. To situate these tools 1, 3 in such a production line, it is said that, upstream the support tool 3, the lids are manufactured and stacked horizontally; and downstream the support tool, the lids, stacked and packaged, are palletized prepared for shipping, for example, by using a palletizing tool 22 (FIG. 1).

In this context, the feed tool 3 is able to provide sets of stacked lids. This feed tool 3 includes a rail 4 and a feed nozzle 5 coupled to the end of this rail 4.

In the present example, the lids have a disc shape and, being stacked one behind the other, they form a horizontal cylindrical stack which is outlined by the cylinder 6 which, in FIG. 1, is shown held by the support tool 1. This cylinder 6 of stacked lids will be called set of lids in the present description.

The feed nozzle 5 has therein a beveled tubular shape at its end, having a diameter greater than the diameter of the set of lids 6, so that the set of lids 6 can be transported on rail 4 to the feed nozzle 5, and can pass through the feed nozzle 5 to be transferred in a package 12 as explained below.

Figure 7:
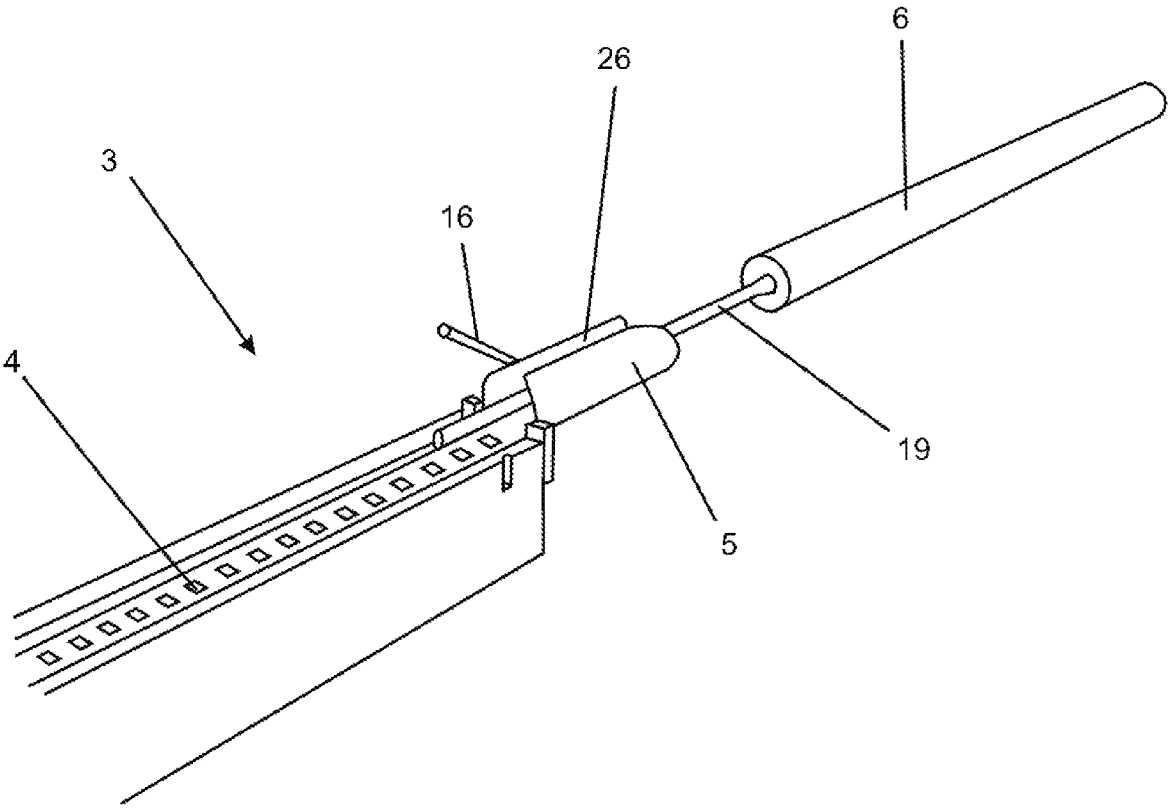

To this end, the feed tool 3 further includes a axial displacement rod 19 movable parallel to rail 4 and adapted to push a set of lids 6 through the feed nozzle 5 (see FIG. 7).

The feed nozzle 5 has a slot 26, so that it is open at its top.

The feed tool 3 also includes an air injection nozzle 16 connected to a compressed air source (not shown) and adapted to produce an air jet into the feed nozzle 5.

The support tool 1, in turn, includes three vacuum terminals that are, in the present example, a front suction cup 8, a center suction cup 9 and a rear suction cup 10 mounted on a rod 7. These suction cups 8, 9, 10 are connected to a vacuum pump (not shown) so as to capture and secure by vacuum a package 12 (see FIGS. 2 to 6). In addition, each suction cup 8, 9, 10 is mounted in a cylinder 13, 14, 15 which allows a translation transverse to shaft 7, between a high position, where the suction cup is near rod 7; and a low position, where the suction cup is away from rod 7.

The support tool 1 also includes a central claw 17 and a front claw 18, the latter being disposed on the side of the front suction cup 8. These jaws 17, 18 are adapted to immobilize a set of lids 6, as shown in FIG. 1.

It is emphasized that this representation of the set of lids 6, secured by the claws 17, 18 is schematic, since the set of lids 6 will be inserted in its package 12 when it is in that position. But for the sake of clarity of FIG. 1, the package 12 was not shown.

The claws 17, 18 are similar in construction to a pair of jaws 20 actuated by actuators 21 adapted to pull away and approach one another the jaws of a pair, with the difference in the length of the jaws, the center claw 17 being longer than the front claw 18. The center claw 17 operates over a wide dimension in the central part of the set of lids 6, and the front claw 18 operates only at the end of the set of lids 6.

A stop 11 is also mounted on the end of the rod 7 opposite the front suction cup 8, and serves to block the end of the set of lids 6.

In addition, the movement of the support tool 1 is provided by the robotic arm 2. The end of the robot arm 2 is coupled to the bar 7 so that the support tool 1 can occupy any position within the range of the robotic arm 2.

The support tool 1 working positions include a position for cooperation with the palletizing tool 22 for depositing the set of lids 6 on a pallet 23. The support tool 1 is thus adapted to fill up pallet 23 depositing therein series of sets of lids 6 with its claws 17, 18 through the mobility provided by the robotic arm 2.

These sets 6 are prepared during the cooperation of the support tool 1 with the feed tool 3, as described below.

Furthermore, the described devices are connected to a classic command unit (not shown) programmed to carry out the following operations.

FIGS. 2 to 6 represent various steps of the packaging operation of a set of lids 6. In these figures, the support tool 1 is outlined for the figures to appear brighter: only the rod 7 and the suction cups 8, 9, 10 are drawn, wherein the claws 17, 18 have been omitted in the drawing for highlighting the cooperation of the suction cups 8, 9, 10 and package 12.

Figure 2:
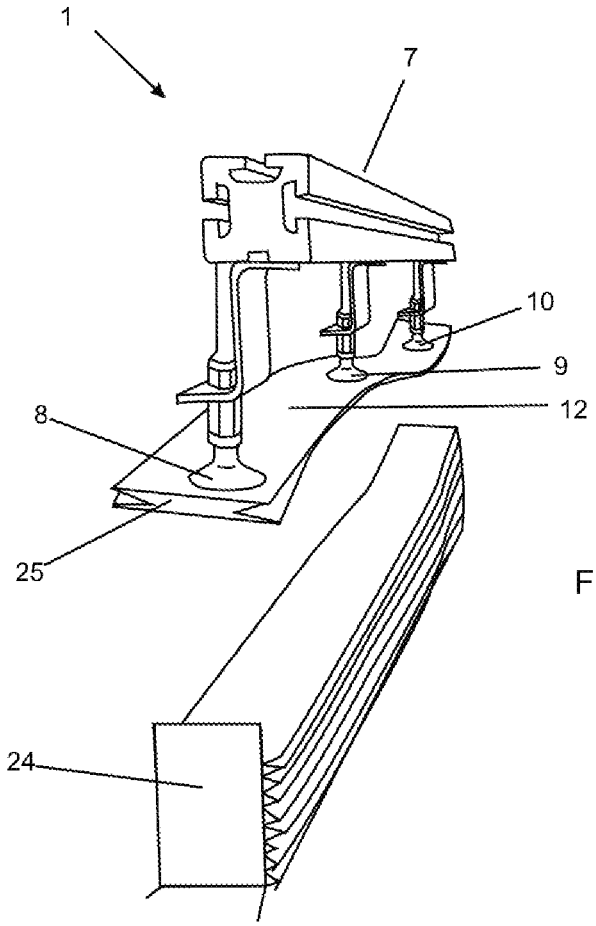
FIGS. 2 to 7 are partial perspective views of the device of FIG. 1 in several illustrating steps of the method according to the invention.

The first step, shown in FIG. 2, is the capture of a package 12. To achieve this position, the claws 17, 18 are opened to the maximum and the cylinders 13, 14, 15 are actuated to place the three suction cups 8, 9, 10 in the low position.

The robotic arm 2 then takes the support tool 1 above storage 24 containing packages 12 that are flattened and stacked.

Next, the robotic arm 2 or the cylinders 13, 14, 15 make the support tool 1 move down until the suction cups 8, 9, 10 come into contact with the package 12 from above; the vacuum pump is then actuated so that package 12 is retained against the suction cups 8, 9, 10; and the robotic arm 2 then carries the support tool back to the first position above storage 24, lifting the captured package 12 to reach the position shown in FIG. 2.

It is emphasized that the displacement of the robotic arm 2 relative to the storage 24 is driven so that the front suction cup 8 comes into contact with the package 12 in a zone of immediate proximity to inlet 25 of package 12. Preferably, the front suction cup 8 is placed 100 mm from inlet 25 and a maximum distance of 150 mm.

Thereafter, cylinders 13, 14, 15 can be activated to put the three suction cups 8, 9, 10 in the high position, or in an intermediate position between the low position and the high position.

Figure 3:
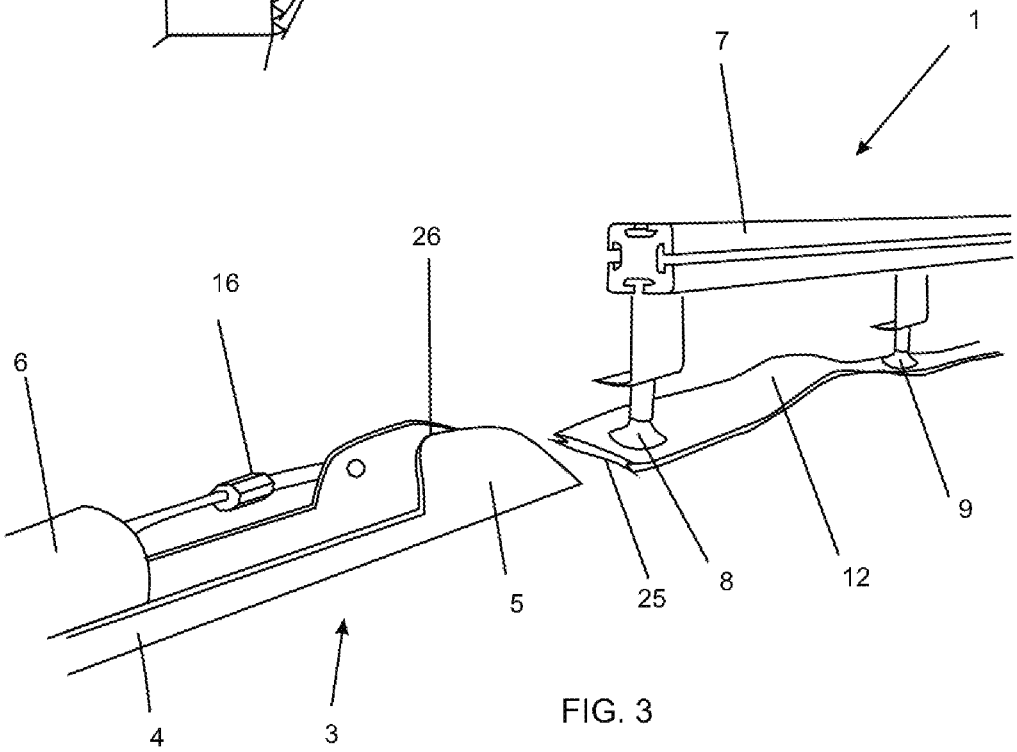

With reference to FIG. 3, afterwards the robotic arm 2 moves the support tool 1 to the feed tool 3, in any place where the feed tool 3 comes within the reach of the robotic arm 2, and places the package 12 in alignment with the power tool 3 so as to present inlet 25 at the level of the feed nozzle 5, preferably, at a distance of 10 mm and a maximum distance of 20 mm.

Preferably, the robotic arm 2 places the package 12 in a way that the inlet 25 is aligned with the tip of the beveled end of the feed nozzle 5.

As shown in FIG. 3, the air injection nozzle 16 is attached to the wall of the feed nozzle 5, and goes through this wall so as to inject an air jet into the feed nozzle 5. Furthermore, the air injection nozzle 16 is positioned at an angle on that wall, facing the outlet of the feed nozzle 5 and, more specifically, facing the tip of the beveled end of the feed nozzle 5. The air jet coming out of the feed nozzle 5 thus has the advantage of being a laminar flow.

Figure 4:
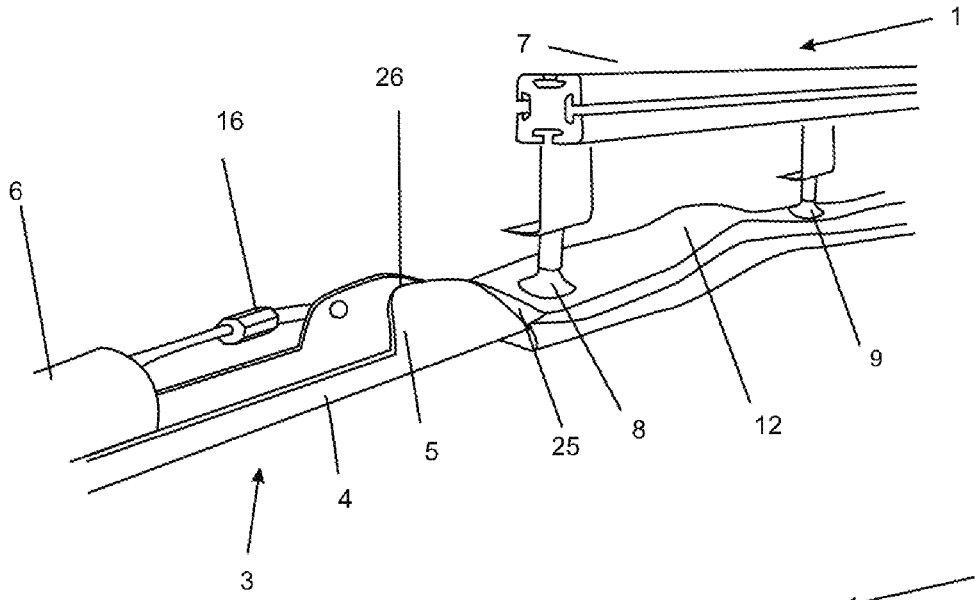

This air jet is then activated, as illustrated in FIG. 4, the laminar flow coming out of the feed nozzle 5 finds the inlet 25 of the package 12 that is secured by the front sucker 8 applied close enough to the inlet 25 so that inlet 25 has as the only option to open, as shown in FIG. 4.

Figure 5:
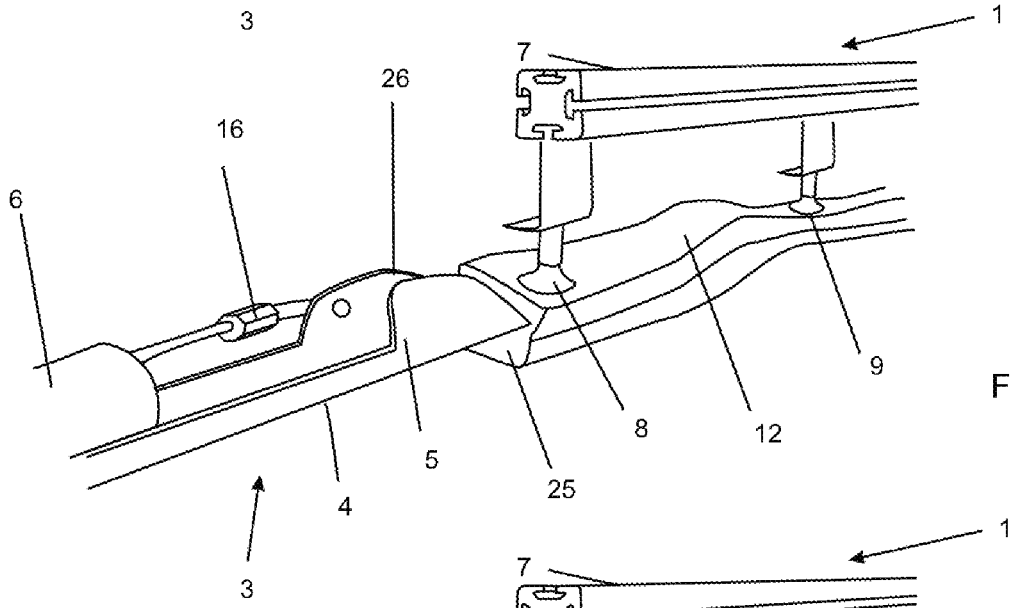

FIG. 5 illustrates the next step in which, when the inlet 25 is thus opened, the robotic arm 2 moves the package 12 towards the feed nozzle 5. During this operation, the air flow is kept on so that the package 12 expands as it goes toward the feed nozzle 5. That is why the package 12 appears in FIG. 5 both more expanded and closer to the feed nozzle 5 when compared with FIG. 4.

The lower portion of inlet 25 of the package 12 is now below the end of the feed nozzle 5, because the inlet 25 has been aligned at the beginning with the tip of the beveled end of the feed nozzle 5, which was then opened downwards with the front suction cup 8 preventing any upward movement.

Thus, the displacement of the package 12 towards the feed nozzle 5 leads to a docking of inlet 25 of the package 12 into the feed nozzle 5.

Figure 6:
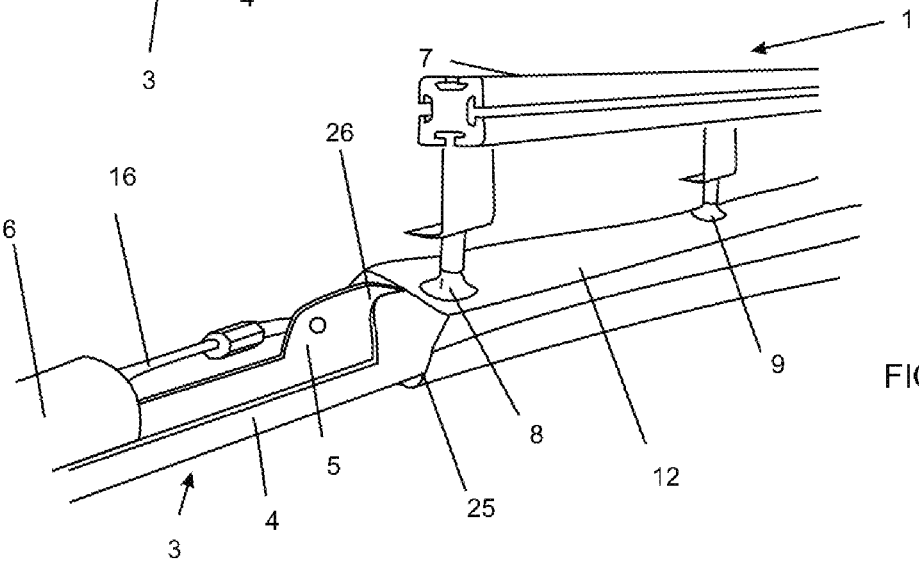

The docking is facilitated by the bevel of the feed nozzle 5, until the package 12 reaches the position of FIG. 6. The slot 26 allows not deforming the package 12 in the area of its cooperation with the front suction cup 8 during this docking phase, in order not to disturb the attachment of the front suction cup 8 on the package 12.

In this position of FIG. 6, when the air jet is maintained, the package 12 turns out to expand and is ready for the transfer of the set of lids 6 into the package 12.

In FIG. 6, the set of lids 6 is on the rail 4 of the feed tool 3, ready to be transferred to the package 12. The set of lids is then pushed longitudinally with the axial displacement rod 19 to go through the feed nozzle 5 to the package 12.

The final position after this operation is shown in FIG. 7, which is a schematic view where the support tool 1 and the package 12 are not represented in order to show position of the axial displacement rod 19 after having pushed the set of lids 6 into the bottom of the package 12. Moreover, the axial displacement rod 19 is actuated by a cylinder that is not shown either.

The set of lids 6 in the transfer phase to the package 12 appears, in relation to the support tool 1, as shown in FIG. 1. During the transfer, the claws 17, 18 can be tightened to softly touch the edges of the set 6. The jaws 20 act as lateral guides to keep the package 12 during the passage of the set of lids 6. In an alternative embodiment, not shown in the drawings, the jaws 20 are fitted with lower nails adapted to maintain the package 12 downward in order to complement the function of the side guides of jaws 20, by a function of supporting and sustaining.

The cylinders 13, 14, 15 can be actuated to adjust the height of the three suction cups 8, 9, 10, that is, the height of the package 12 for the cooperation between the package and the claws 17, 18.

At the end of the transfer, the axial displacement rod 19 pushes the set of lids 6 until it is pressed with the package 12 against the stop 11, and the axial displacement rod exert an axial compression on the set of lids 6. The set of lids 6, being deformed because it consists of aggregated elements, might have a tendency to flex by buckling due to the axial compression. The roles of side guides, and eventually supporting and sustaining, of the claws 17, 18 allow prevent such buckling and ensure that the set of lids 6 remain straight.

The claws 17, 18 are then actuated to press the set of lids 6 with sufficient force for retention of the lids in the package and keeping of the axial compression between the front claw 18 and the stop 11.

The suction cups 8, 9, 10 can be disabled at any time where the package does not need their actuation anymore.

The robotic arm 2 then moves the support tool 1 for conveying the set of lids 8, thus held in the claws 17, 18 to the palletizing tool 22, eventually passing by other facilities carrying out known additional operations, such as package gluing.

Having described an example of a preferred embodiment, it should be understood that the scope of the present invention encompasses other possible variations, being limited solely by the wording of the appended claims, including the possible equivalents therein. For example, the air injection nozzle and/or feed nozzle can be mounted in the support tool 1, with a possible movement relative to the suction cups 8, 9, 10 and claws 17, 18.

The invention claimed is:

1. A method of packaging a set of stacked lids, characterized in that it includes the following steps:

capturing an elongate package (12) with at least one vacuum terminal (8) mounted on a support tool (1);

moving the support tool (1), carrying the package (12) to a position where an inlet (25) of the package (12) cooperates with a feed tool (3);

immobilizing the package (12) with at least one immobilizing device (11, 18, 20) mounted on the support tool (1) and disposed about the package (12);

transferring into the package (12) a set of stacked lids (6), wherein after the step of transferring into the package (12) a set of stacked lids (6), the method includes a step of compressing the set of lids (6) against the at least one immobilizing device comprising a stop (11).

2. The method of packaging according to claim 1 wherein the set of lids (6) is kept compressed between the stop (11) and another immobilizing device consisting of a front claw (18).

3. The method of packaging according claim 1 further comprising the step of keeping straight an elongate package (12), wherein the step of keeping straight an elongate package (12) is carried out by maintaining the package (12) between the front vacuum terminal (8) and a rear vacuum terminal (10), mounted aligned on the support tool (1).

4. The method of packaging according to claim 1 wherein the step of moving the support tool (1) to a position for cooperating with a feed tool (3) is performed after opening the inlet (25) of the package (12).

5. The method of packaging according to claim 4 wherein the step of moving the support tool (1) to a position for cooperating with a feed tool (3) is performed by fitting the inlet (25) of the package (12) in a feed nozzle (5) of the feed toll (3).

6. The method of packaging according to claim 1 wherein the step of immobilizing the package (12) with at least one immobilizing device is performed with at least one claw (17, 18) adapted to cooperate with the side part of the package (12).

7. A method of packaging a set of stacked lids, characterized in that it includes the following steps:

capturing an elongate package (12) with at least one vacuum terminal (8) mounted on a support tool (1);

moving the support tool (1), carrying the package (12) to a position where an inlet (25) of the package (12) cooperates with a feed tool (3);

immobilizing the package (12) with at least one immobilizing device (11, 18, 20) mounted on the support tool (1) and disposed about the package (12);

transferring into the package (12) a set of stacked lids (6), wherein the step of immobilizing the package (12) with at least one immobilizing device is performed with a stop (11) adapted to cooperate with the end of the package (12) opposite the inlet (25).

* * * * *